US009020387B2

(12) United States Patent
Onishi et al.

(10) Patent No.: US 9,020,387 B2
(45) Date of Patent: Apr. 28, 2015

(54) PHOTOSENSITIVE DRUM AND IMAGE FORMING APPARATUS HAVING THE SAME

(71) Applicant: Kyocera Document Solutions Inc., Osaka (JP)

(72) Inventors: Masato Onishi, Osaka (JP); Mitsuhiro Goda, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/927,821

(22) Filed: Jun. 26, 2013

(65) Prior Publication Data

US 2014/0003840 A1 Jan. 2, 2014

(30) Foreign Application Priority Data

Jun. 28, 2012 (JP) ..... 2012-144948

(51) Int. Cl.
*G03G 21/20* (2006.01)
*G03G 15/00* (2006.01)
*G03G 21/16* (2006.01)

(52) U.S. Cl.
CPC ..... *G03G 15/751* (2013.01); *G03G 21/1671* (2013.01); *G03G 21/206* (2013.01)

(58) Field of Classification Search
USPC ..... 399/96, 117; 165/DIG. 150
See application file for complete search history.

(56) References Cited

U.S. PATENT DOCUMENTS

| | | | | |
|---|---|---|---|---|
| 3,994,053 | A * | 11/1976 | Hunt | 492/18 |
| 4,585,319 | A * | 4/1986 | Okamoto et al. | 399/96 |
| 5,788,382 | A * | 8/1998 | Egbert et al. | 400/118.3 |
| 7,024,130 | B2 * | 4/2006 | Serizawa et al. | 399/96 |
| 8,121,521 | B2 * | 2/2012 | Bateman, III | 399/117 |
| 8,213,835 | B2 * | 7/2012 | Okamoto | 399/167 |
| 2008/0279584 | A1 * | 11/2008 | Huang et al. | 399/117 |

FOREIGN PATENT DOCUMENTS

| | | |
|---|---|---|
| JP | 08-123250 | 5/1996 |
| JP | 2002-278363 | 9/2002 |

* cited by examiner

*Primary Examiner* — Clayton E LaBalle
*Assistant Examiner* — Leon W Rhodes, Jr.
(74) *Attorney, Agent, or Firm* — K&L Gates LLP

(57) ABSTRACT

A photosensitive drum has a drum sleeve and a pair of drum flanges. At least one of the pair of drum flanges each has a flange part, a retaining part, and a linking part. The flange part is fitted to the drum sleeve. The retaining part, which is located inward of the flange part in the axial direction of the drum sleeve, pivotably supports a shaft that rotates the photosensitive drum. Openings are formed between the flange part and the retaining part in a direction intersecting the axial direction. An air flow enters the interior of the photosensitive drum from the openings.

10 Claims, 10 Drawing Sheets

PHOTOSENSITIVE DRUM AND IMAGE FORMING APPARATUS HAVING THE SAME

INCORPORATION BY REFERENCE

This application is based upon, and claims the benefit of priority from, corresponding Japanese Patent Application No. 2012-144948 filed in the Japan Patent Office on Jun. 28, 2012, the entire contents of which are incorporated herein by reference.

BACKGROUND

The present disclosure relates to a photosensitive drum and an image forming apparatus having same.

In an image forming apparatus that forms an image on a sheet, a toner image is formed on a photosensitive drum and a transfer unit transfers the toner image to a sheet. Since the image forming apparatus has a fixing unit, the sheet on which the toner image has been transferred undergoes fixing processing, after which the sheet is discharged outside the apparatus.

The photosensitive drum has a sleeve, which is a cylindrical body, a pair of flanges fitted to both ends of the sleeve, and a shaft extending from the pair of flanges each toward the outer side, in the axial direction of the photosensitive drum. When the shaft is inserted into a bearing included in the main body of the image forming apparatus, the photosensitive drum is rotatably supported. An electrostatic latent image is formed on the circumferential surface of the sleeve, after which the latent image is visualized as a toner image. If the temperature of the photosensitive drum is raised during this process, toner may adhere to the sleeve of the photosensitive drum.

To cool the photosensitive drum, therefore, a flow air may be allowed to enter the interior of the sleeve through holes formed in each of the pair of flanges of the photosensitive drum.

However, since the holes in each of the pair of flanges are formed toward the axial direction of the photosensitive drum, the openings of the holes are limited to a size smaller than the area of the pair of flanges each. This prevents the flow air from easily entering the interior of the photosensitive drum through the holes formed in each of the pair of flanges. Accordingly, a flow air having a sufficient amount of air to cool the photosensitive drum is difficult to obtain.

SUMMARY

In an embodiment of the present disclosure a photosensitive drum is provided that has a drum sleeve and a pair of drum flanges. The drum sleeve is formed with a cylindrical body that, which is rotationally driven to form a latent image on its surface and supports a toner formed based on the latent image. At least one of the pair of drum flanges includes a flange part that rotatably supports the drum sleeve in an integrated manner, a retaining part that retains a drum shaft that acts as a rotational axis in the rotation of the drum sleeve, the retaining part being located inward of the flange part in the axial direction of the drum sleeve, and a linking part that links the flange part and retaining part together. At the linking part and the pair of drum flanges each fitted to the both ends of the drum sleeve, there are openings formed between the flange part and the retaining part in a plane intersecting the axial direction, the openings communicating with the cylindrical interior of the drive sleeve.

An image forming apparatus, in another embodiment of the present disclosure, includes a photosensitive drum, a drum shaft, supported by a retaining part of a pair of drum flanges each, that acts as a rotational axis in the rotation of a drum sleeve, and a developing device that forms a toner image on the drum sleeve.

Additional features and advantages are described herein, and will be apparent from the following Detailed Description and the figures.

DETAILED DESCRIPTION

An embodiment of the present disclosure will be described with reference to the drawings. Elements in structures, placements, and the like described in the embodiment below do not limit the range of the disclosure, but they are only used for explanatory purposes.

Figure 1:
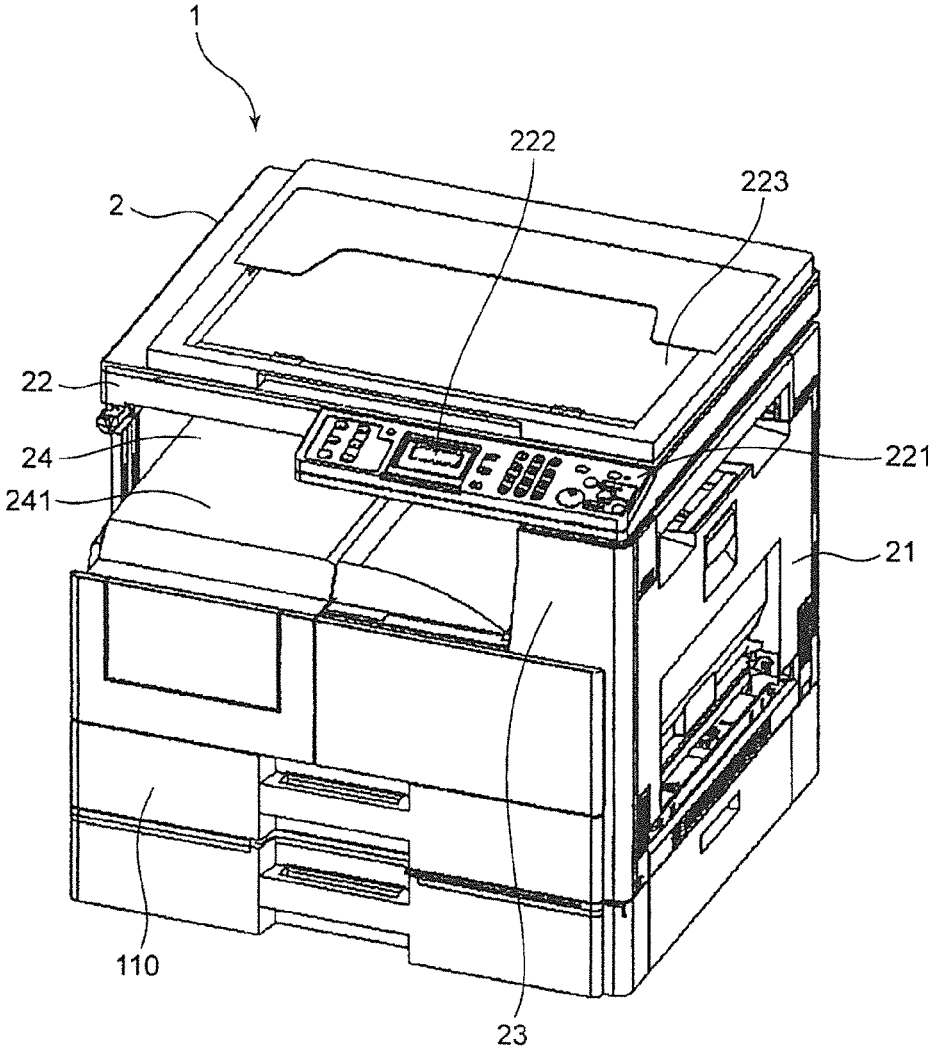
FIG. 1 is a perspective view illustrating an image forming apparatus in an embodiment of the present disclosure.

FIG. 1 is a perspective view illustrating the external appearance of an image forming apparatus 1 in an embodiment of the present disclosure.

Figure 2:
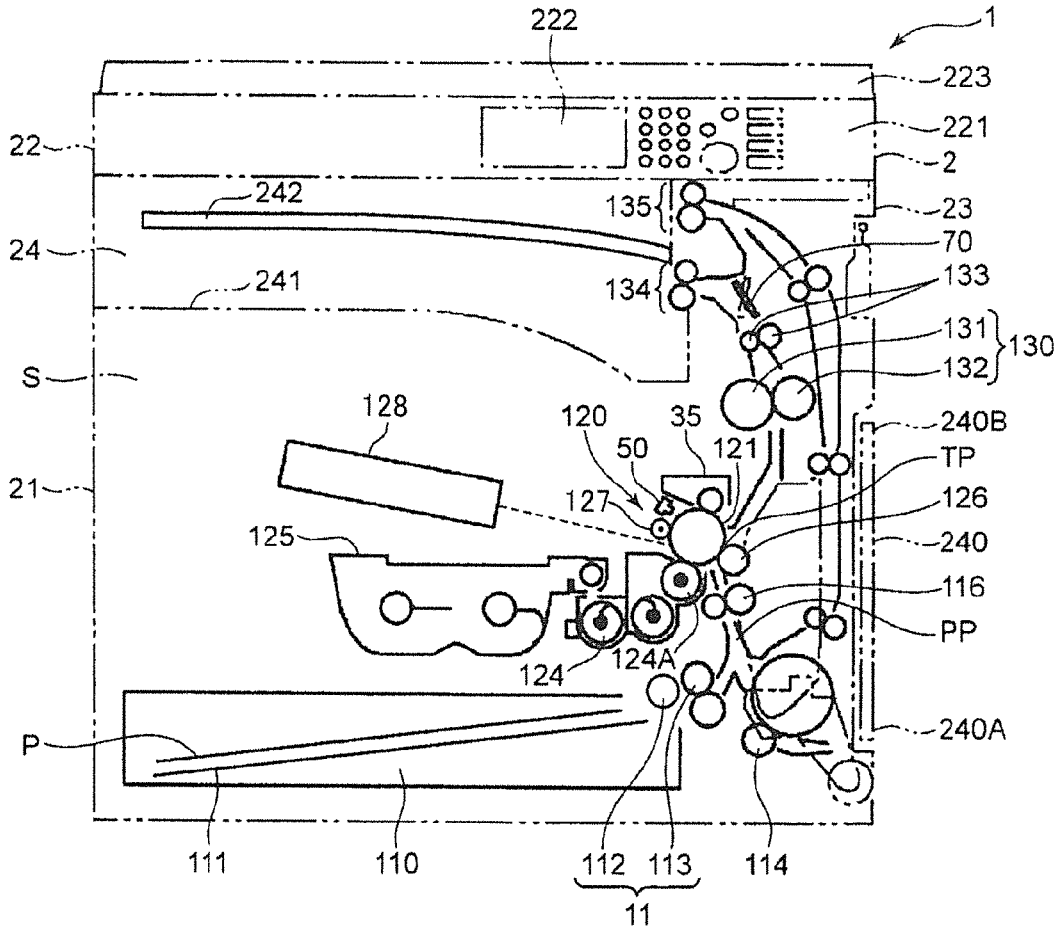
FIG. 2 is an internal cross-sectional view illustrating the image forming apparatus in an embodiment of the present disclosure.

FIG. 2 is a cross-sectional view illustrating the interior of the image forming apparatus 1.

The image forming apparatus 1 in FIGS. 1 and 2 is a so-called monochrome multi-function peripheral. In other embodiments, however, the image forming apparatus may be a color multi-function peripheral, a color printer, a facsimile machine, or another apparatus that forms a toner image on a sheet. In the descriptions below, the term "sheet" refers to a copy sheet, a coated sheet, an overhead projection (OHP) sheet, a thick sheet, a postcard, tracing paper, or another sheet that undergoes image forming processing or any processing other than image forming processing.

The image forming apparatus 1 includes a main body 2, which is a substantially rectangular parallelepiped. The main body 2 includes a lower body 21, which is a substantially rectangular parallelepiped, an upper body 22, positioned above the lower body 21, which is a substantially rectangular parallelepiped, and a linking body 23 that links the lower body 21 and upper body 22 together. The linking body 23 extends along the right edge and rear edge of the main body 2. Sheets on which printing processing has been performed are discharged into a discharge space 24 enclosed by the lower body 21, upper body 22, and linking body 23. Particularly, in this embodiment, sheets are discharged to a discharge unit 241 placed on the upper surface of the lower body 21 and to a discharge tray 242 (see FIG. 2) placed above the discharge unit 241.

A operation unit 221 placed on the front side of the upper body 22 includes, for example, a liquid crystal display (LCD) touch panel 222. The operation unit 221 is formed so as to accept information related to image forming processing. The user can input, for example, the number of sheets on which printing is to be performed, a print density, and the like through the LCD touch panel 222. Main components located in the upper body 22 are a device configured to read images of manuscripts and electronic circuits that are responsible for controlling the image forming apparatus 1.

A pressing cover 223, placed on the upper body 22, is used to press a manuscript. The pressing cover 223 is attached to the upper body 22 so as to be vertically swingable. The user upwardly swings the pressing cover 223 and places a manuscript on the upper body 22. The user can then operate the operation unit 221 causing a unit placed in the upper body 22 to read the image of the manuscript.

A manual tray 240 (see FIG. 2) is placed on the right side surface of the lower body 21. The upper end 240B of the manual tray 240 is vertically swingable with its lower end 240A acting as a pivot point. When the manual tray 240 is downwardly swung and is positioned so as to extend to the right of the lower body 21, the user can place sheets on the manual tray 240. A sheet on the manual tray 240 is pulled into the interior of the lower body 21 in response to a command entered by the user through the operation unit 221, after which the sheet undergoes image forming processing and is then discharged to the discharge space 24. There is an internal space S (see FIG. 2), in which various types of units described later are located, in the lower body 21.

The image forming apparatus 1 includes, in the internal space S, a cassette 110, a feed unit 11, a second feed roller 114, a resist roller pair 116, and an image forming unit 120. The feed unit 11 includes a pickup roller 112 and a first feed roller 113. The feed unit 11 feeds out a sheet P to a sheet transport path PP. The sheet transport path PP extends from the feed unit 11, and after passing the resist roller pair 116, passes a transfer position TP located in the image forming unit 120.

The cassette 110 stores sheets P. The cassette 110 can be pulled from the lower body 21 in a direction in which the front of the image forming apparatus 1 faces (direction out of the drawing sheet of FIG. 1). In the lower body 21, the sheets P stored in the cassette 110 are upwardly fed out. Each sheet P then undergoes image forming processing in the lower body 21 in response to a command entered by the user through the operation unit 221, after which the sheet P is discharged to the discharge space 24. The cassette 110 has a lifting plate 111 that supports the sheet P. The lifting plate 111 is inclined so as to upwardly push the top edge of the sheet P.

The pickup roller 112 is positioned so as to be placed on the top edge of the sheet P that has been upwardly pushed by the lifting plate 111. When the pickup roller 112 is rotated, the sheet P is drawn from the cassette 110.

The first feed roller 113 is located downstream of the pickup roller 112 in the sheet transport direction. The first feed roller 113 further feeds out the sheet P to the downstream side in the sheet transport direction. The second feed roller 114 is located inward (left side in FIG. 2) of the lower end 240A of the manual tray 240. The second feed roller 114 transports sheets P on the manual tray 240 to the interior of the lower body 21. The user can selectively use sheets P accommodated in the cassette 110 and sheets P placed on the manual tray 240.

The resist roller pair 116 regulates the position, in a direction orthogonal to the sheet transport direction, of the sheet. Thus, the position of an image formed on the sheet P is adjusted. The resist roller pair 116 forms a nip part between the rollers. In the image forming unit 120, the resist roller pair 116 transports the sheet P to the image forming unit 120 so that the transport is timed with a transfer of a toner image onto the sheet P. The resist roller pair 116 also functions to correct a skew of the sheet P, if any.

The image forming unit 120 includes a photosensitive drum 121, a charger 127, an exposing device 128, a developing device 124, a toner container 125, a transfer roller 126, a cleaning unit 35, and a static eliminator 50.

The photosensitive drum 121 is shaped like a substantially cylindrical body. The photosensitive drum 121 enables an electrostatic latent to be formed on its circumferential surface and supports a toner image matching the electrostatic latent.

When a prescribed voltage is applied to the charger 127, it substantially uniformly charges the circumferential surface of the photosensitive drum 121. The exposing device 128 emits laser beams to the circumferential surface, which has been charged by the charger 127, of the photosensitive drum 121. The laser beams are emitted based on the image data outputted from an external apparatus (not illustrated), such as a personal computer, that is connected to the image forming apparatus 1 in such a way that communication is possible therebetween. As a result, an electrostatic latent corresponding to the image data is formed on the circumferential surface of the photosensitive drum 121.

The developing device 124 supplies toner to the circumferential surface of the photosensitive drum 121 on which the electrostatic latent has been formed. The toner container 125 supplies toner to the developing device 124. Specifically, the toner container 125 supplies toner to the developing device 124 sequentially or as necessary. After the developing device 124 has supplied toner to the photosensitive drum 121, the electrostatic latent formed on the circumferential surface of the photosensitive drum 121 is developed (visualized). As a result, a toner image is formed on the circumferential surface of the photosensitive drum 121. The developing device has a developing roller 124A that supports toner on the circumferential surface. The developing roller 124A is positioned facing the photosensitive drum 121 at a developing position. The developing roller 124A is rotationally driven and supplies toner to the photosensitive drum 121.

The transfer roller 126 is positioned facing the circumferential surface of the photosensitive drum 121 at the transfer position TP. The transfer roller 126 is rotationally driven at the transfer position TP in the same direction as the photosensitive drum 121. At the transfer position TP, the toner image formed on the circumferential surface of the photosensitive drum 121 is transferred to the sheet P.

After the toner image has been transferred to the sheet P, the cleaning unit 35 removes remaining toner from the circumferential surface of the photosensitive drum 121. The static eliminator 50 emits prescribed charge-neutralizing light to the photosensitive drum 121, the circumferential surface of which has been cleaned by the cleaning unit 35. As a result, potential on the circumferential surface of the photosensitive drum 121 is uniformed.

Upon completion of the cleaning by the cleaning unit 35, the circumferential surface of the photosensitive drum 121, charges on which have been removed by the static eliminator 50, passes below the charger 127 again and is uniformly charged. A toner image is formed again as described above.

The image forming apparatus 1 also includes a fixing device 130, which fixes the toner image formed on the sheet P, downstream of the image forming unit 120 in the transport direction. The fixing device 130 includes a heating roller 131, which melts toner on the sheet P, and a pressurizing roller 132, which brings the sheet P into tight contact with the heating roller 131. When the sheet P passes between the heating roller 131 and the pressurizing roller 132, the toner image is fixed onto the sheet P.

The image forming apparatus 1 further includes a transport roller pair 133 positioned downstream of the fixing device 130, a switchover unit 70 positioned downstream of the transport roller pair 133, a lower discharge roller pair 134, and an upper discharge roller 135. The transport roller pair 133 transports the sheet P on which fixing processing has been performed by the fixing device 130 to the downstream side in the sheet transport direction. The switchover unit 70 functions to select a direction in which to transport the sheet P on the downstream of transport roller pair 133 in the sheet transport direction. The lower discharge roller pair 134, located to the left of the switchover unit 70, discharges the sheet P transported by the transport roller pair 133 to the discharge unit 241. The upper discharge roller 135, located above the lower discharge roller pair 134, discharges the sheet P transported by the transport roller pair 133 to the discharge tray 242 positioned above the discharge unit 241.

Figure 3:
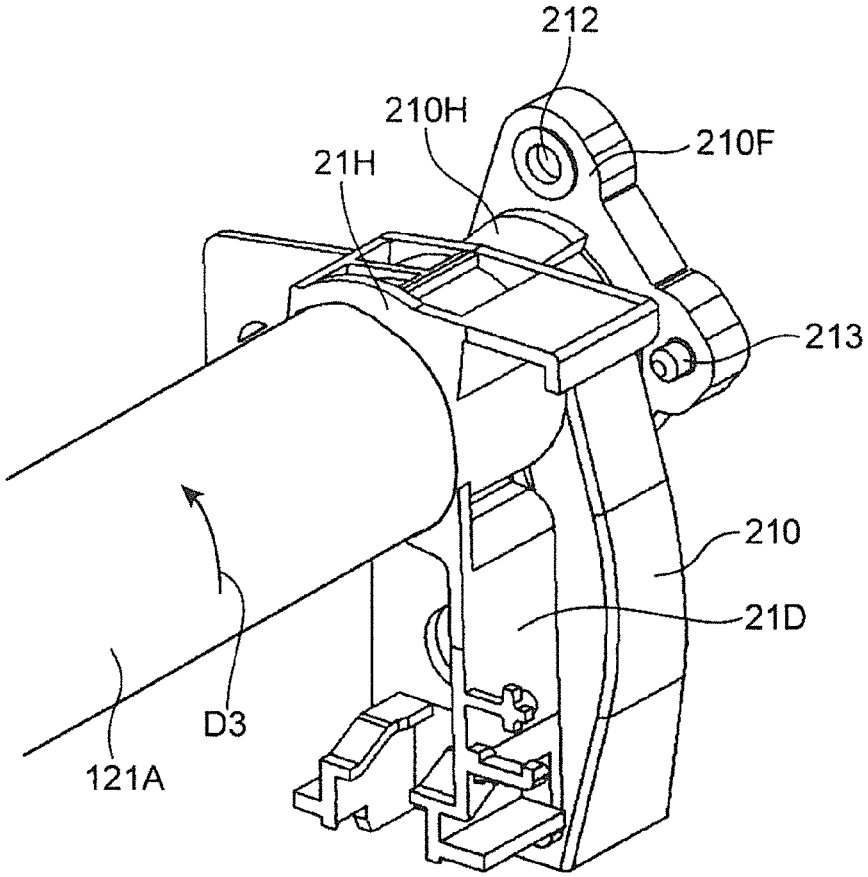
FIG. 3 is a perspective view illustrating the periphery of part of an end of a photosensitive drum in the interior of the image forming apparatus in an embodiment of the present disclosure.
Figure 4:
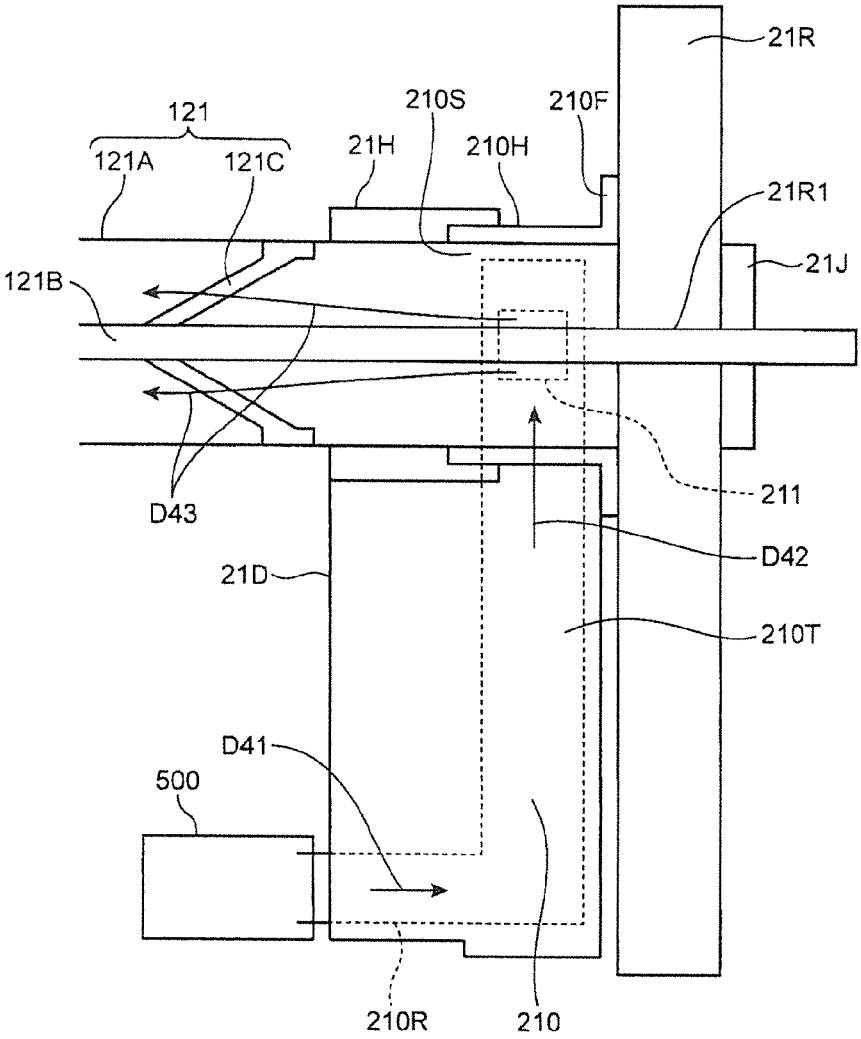
FIG. 4 is a cross-sectional view illustrating the periphery of part of the end of the photosensitive drum in the interior of the image forming apparatus in an embodiment of the present disclosure.
Figure 5:
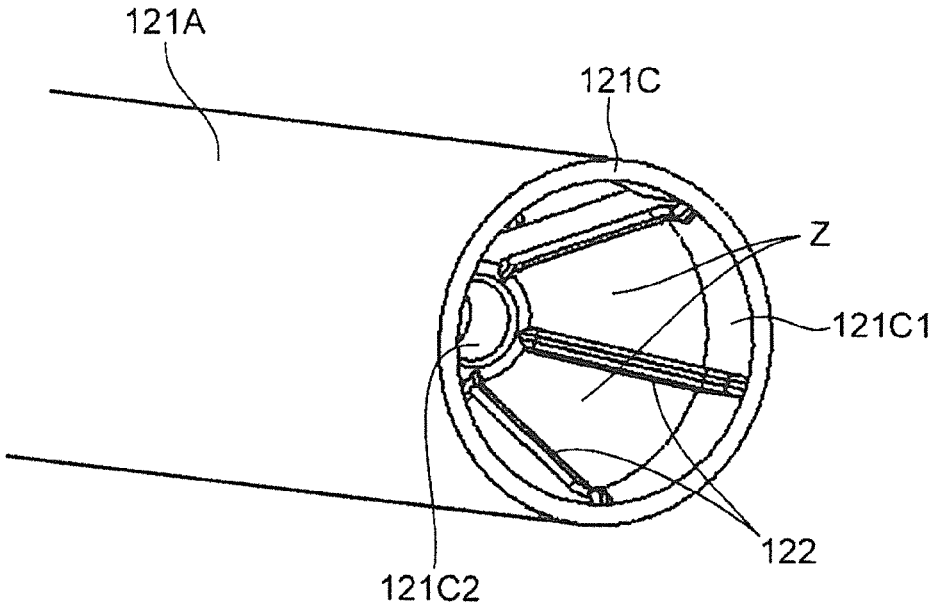
FIG. 5 is a perspective view illustrating the end of the photosensitive drum in an embodiment of the present disclosure.
Figure 6A:
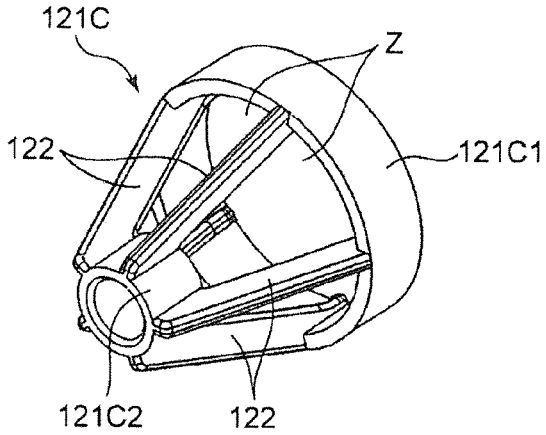
FIG. 6A is a perspective view of a drum flange in an embodiment of the present disclosure as viewed from a bearing.
Figure 6B:
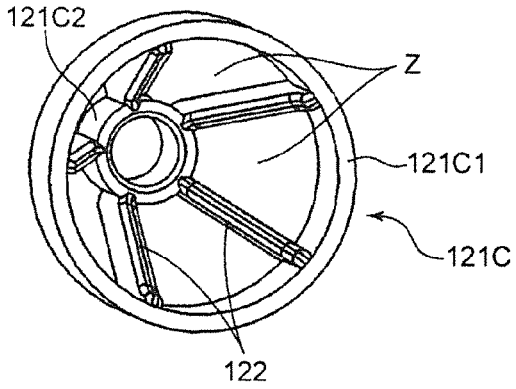
FIG. 6B is a perspective view of the drum flange in an embodiment of the present disclosure as viewed from a flange part.
Figure 6C:
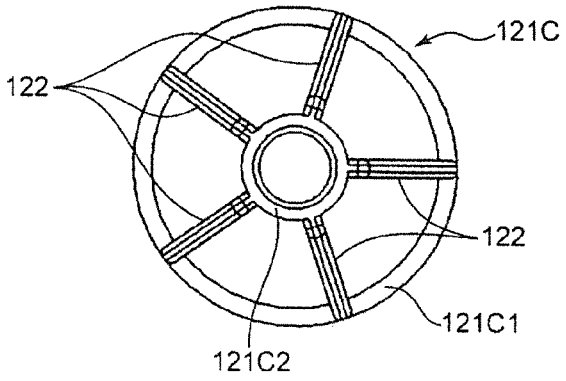
FIG. 6C is a front view of the drum flange in an embodiment of the present disclosure as viewed from the flange part.

Next, the structure of the photosensitive drum 121, in an embodiment, will be described with reference to FIGS. 3 to 6C. FIGS. 3 and 4 are respectively a perspective view and a cross-sectional view that illustrate the periphery of part of an end of the photosensitive drum 121 in the interior of the image forming apparatus 1 in this embodiment. FIG. 5 is a perspective view illustrating the end of the photosensitive drum 121 in this embodiment. FIGS. 6A and 6B are a perspective view of a drum flange 121C in this embodiment. FIG. 6C is a front view of the drum flange 121C in this embodiment.

The photosensitive drum 121 includes a drum sleeve 121A and the drum flange 121C as illustrated in FIGS. 4 and 5. The image forming apparatus 1 includes a drum shaft 121B.

The drum sleeve 121A is a cylindrical body that forms the main part of the photosensitive drum 121. The drum sleeve 121A is rotationally driven. The drum sleeve 121A supports a toner image formed based on a latent image formed on the surface of the drum sleeve 121A. The cylindrical interior of the drum sleeve 121A is hollow. A photosensitive layer is formed on the surface of the drum sleeve 121A using an amorphous silicon (a-Si) based material or organic materials.

The drum shaft 121B is inserted into the interior of the drum sleeve 121A and functions as a rotational axis to rotate the drum sleeve 121A (photosensitive drum 121). In this embodiment, the drum shaft 121B is positioned so as to pass through the interior of the drum sleeve 121A and outwardly extends from both ends of the drum sleeve 121A in its axial direction. However, the drum shaft 121B may be linked to the drum flange 121C, described later, so as to extend from the drum flange 121C toward the outer side in the axial direction without passing through the interior of the drum sleeve 121A.

The drum flange 121C is fitted to an end of the drum sleeve 121A. The drum flange 121C includes a flange part 121C1 and a bearing 121C2 (retaining part), and linking ribs 122 (linking part) as illustrated in FIGS. 6A to 6C.

The flange part 121C1 rotatably supports the drum sleeve 121A in an integrated manner. The flange part 121C1 is a circular tubular member having an outer diameter that is slightly smaller than the inner diameter of the drum sleeve 121A. When the flange part 121C1 is fitted to the end of the drum sleeve 121A, the drum flange 121C and drum sleeve 121A are integrated into one unit.

The bearing 121C2 is located inward of the flange part 121C1 in the axial direction of the drum shaft 121B (see FIG. 4). The bearing 121C2 is a circular tubular member having an inner circumferential part corresponding to the outer diameter of the drum shaft 121B. The drum shaft 121B is inserted into the inner circumferential part of the bearing 121C2. The drum shaft 121B is rotatably supported by the bearing 121C2.

Each linking rib 122, which extends in a radial direction and the axial direction of the drum sleeve 121A, links the flange part 121C1 and the bearing 121C2 together. The linking rib 122 is a plate-like member that has a slight thickness in the rotational direction of the photosensitive drum 121 and also has a defined width in the axial direction of the photosensitive drum 121. A plurality of linking ribs 122 are positioned around the outer circumferential part of the bearing 121C2.

An opening Z is formed between each two of the plurality linking ribs 122. In other words, the opening Z is formed between the bearing 121C2 and the flange part 121C1 of the drum flange 121C in a plane intersecting the axial direction of the drum shaft 121B. The opening Z communicates with the cylindrical interior of the drum sleeve 121A.

An end of the photosensitive drum 121 is attached at the back of the lower body 21 of the image forming apparatus 1, as illustrated in FIGS. 3 and 4. The lower body 21 includes a back wall 21R (see FIG. 4) and a drum frame 21D.

The back wall 21R is a wall at the back of the lower body 21. The back wall 21R includes a main body bearing 21J. The main body bearing 21J is located on a rear surface of the back wall 21R. Before the photosensitive drum 121 is attached to the lower body 21, an end of the drum shaft 121B is inserted into a through-hole 21R1 formed in the back wall 21R and is then secured to the main body bearing 21J. After that, the drum shaft 121B is retained by the bearing 121C2 of the photosensitive drum 121. In other words, the photosensitive drum 121 becomes rotatable with respect to the drum shaft 121B at the bearing 121C2. In addition, a driving member (not illustrated) and the drum flange 121C are linked together, so a rotational driving force is transmitted to the photosensitive drum 121. As a result, the photosensitive drum 121 becomes rotatable. In this embodiment, the drum shaft 121B functions as a so-called fixed axis.

The drum frame 21D is a wall part that is erected parallel to the back wall 21R, inward of the back wall 21R. The drum frame 21D has a drum insertion part 21H. The drum insertion part 21H has a cylindrical shape having an inner diameter slightly larger than the outer diameter of the drum sleeve 121A. As illustrated in FIG. 4, part of an end of the drum sleeve 121A is inserted into the inner circumferential part of the drum insertion part 21H.

Figure 7:
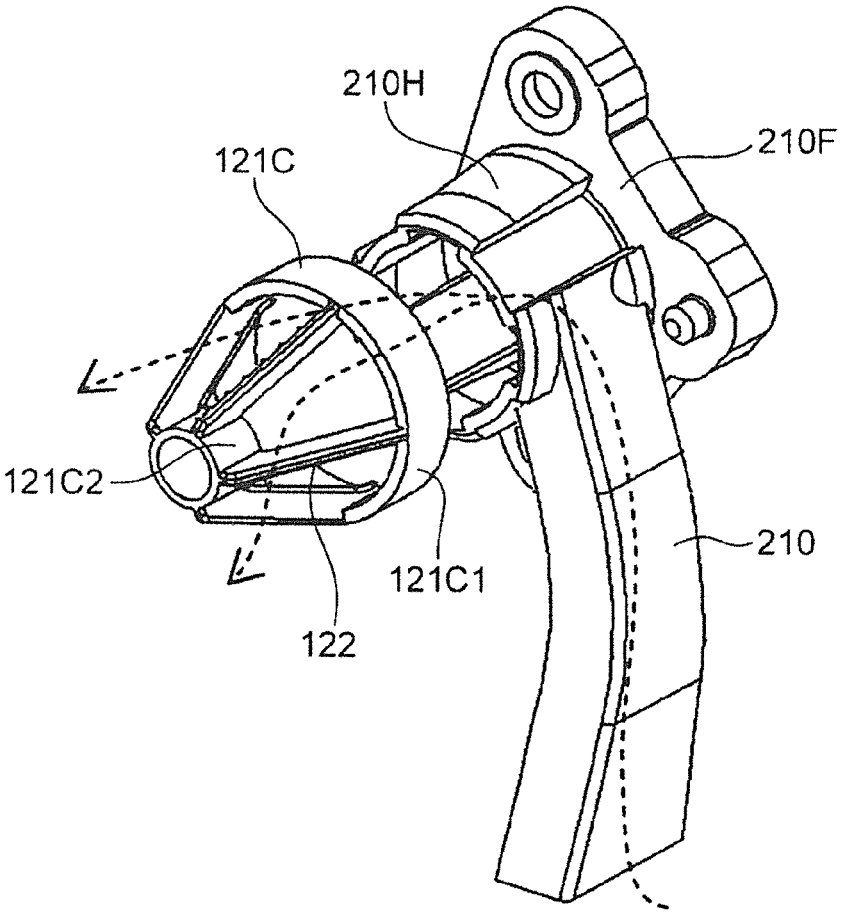
FIG. 7 is an exploded perspective view illustrating the periphery of an end of the photosensitive drum in the interior of the image forming apparatus in an embodiment of the present disclosure.
Figure 8:
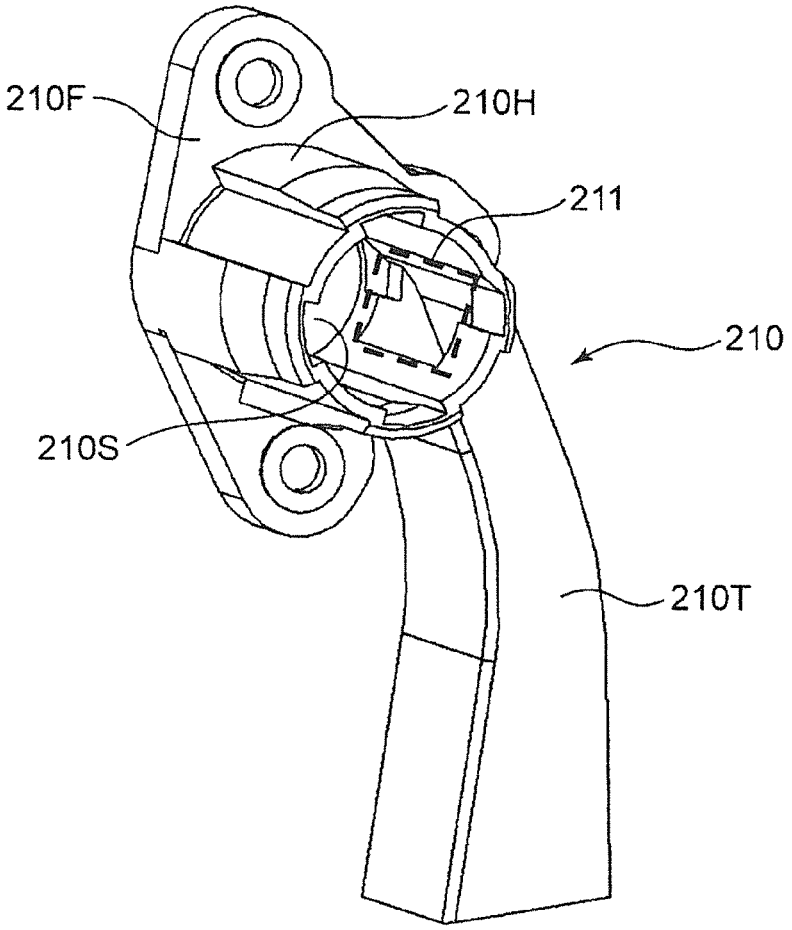
FIG. 8 is a perspective view illustrating a cooling duct in an embodiment of the present disclosure.
Figure 9:
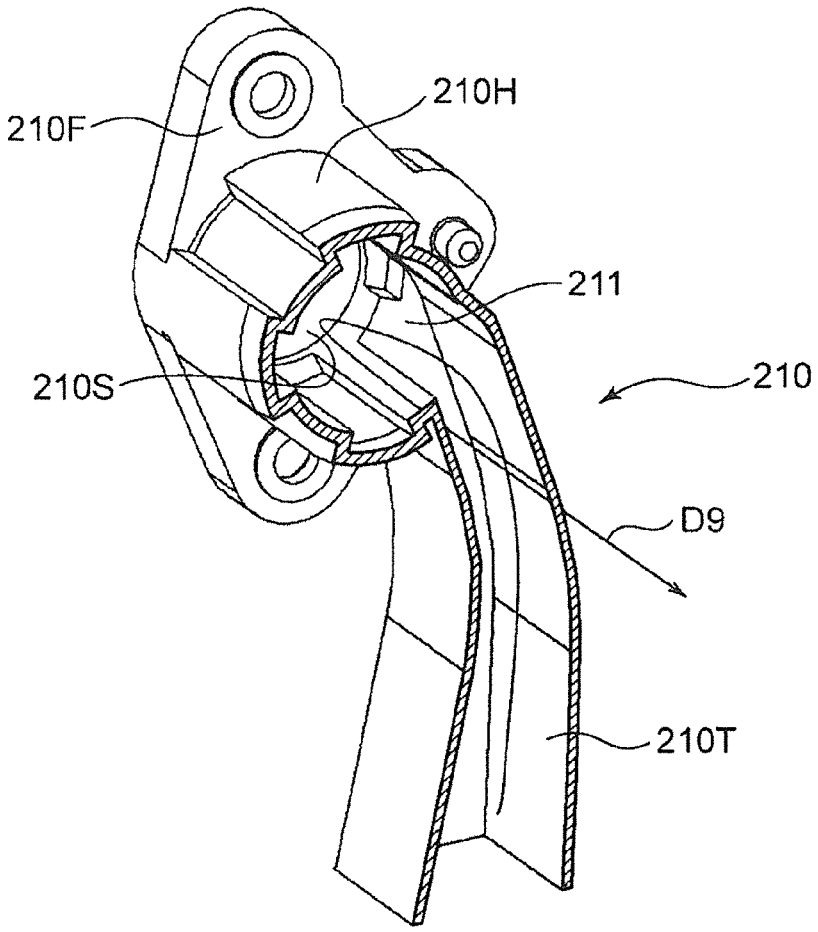
FIG. 9 is a cross-sectional perspective view illustrating the cooling duct in an embodiment of the present disclosure.

Next, a structure by which the photosensitive drum 121 is cooled in the image forming apparatus 1 will be described with reference to FIGS. 4 and 7 to 9. FIG. 7 is an exploded perspective view illustrating the periphery of an end of the photosensitive drum 121 in the interior of the lower body 21. FIG. 7 illustrates the drum frame 21D removed from FIG. 3. FIG. 8 is a perspective view illustrating a cooling duct 210 in this embodiment. FIG. 9 is a cross-sectional perspective view illustrating the cooling duct 210.

The lower body 21 has the cooling duct 210 between the drum frame 21D and the back wall 21R. The lower body 2 also has a cooling fan 500 as an air flow generating source.

The cooling duct 210 includes a cylindrical part 210H, a duct part 210T, an inlet opening 211, and a securing part 210F.

The cylindrical part 210H is positioned facing the drum flange 121C in the axial direction of the drum shaft 121B. The cylindrical part 210H has an internal space 210S having an opening facing the drum flange 121C. An end on the front side of the cylindrical part 210H is fitted to the inner circumferential part of the drum insertion part 21H, as illustrated in FIG. 4. As a result, the internal space 210S of the cylindrical part 210H and the cylindrical interior of the photosensitive drum 121 mutually communicate through the drum insertion part 21H.

The duct part 210T is shaped like a slightly curved rectangular column. The duct part 210T is an air path that upwardly extends. The upper end of the duct part 210T is adjacent to the right side of the outer circumferential part of the cylindrical part 210H. The duct part 210T has a shape that is curved along the outer circumferential part of the cylindrical part 210H, as illustrated in FIGS. 8 and 9. That is, the duct part 210T is curved so that it comes closer to the outer circumferential part of the cylindrical part 210H at upper positions.

The inlet opening 211 is formed in the outer circumferential part of the cylindrical part 210H. The inlet opening 211 has a substantially rectangular shape. The air path of the duct part 210T and the internal space 210S of the cylindrical part 210H mutually communicate through the inlet opening 211.

The securing part 210F is a collar located at the back end of the cylindrical part 210H. The securing part 210F has a fastening hole 212 and a stud 213, as illustrated in FIG. 3. The stud 213 is inserted into a hole (not illustrated) formed in the back wall 21R. A screw (not illustrated) inserted into the fastening hole 212 is tightened into the back wall 21R. Thus, the cooling duct 210 is secured to the back wall 21R.

The cooling fan 500 (see FIG. 4), located in the lower body 21, is rotationally driven by a motor (not illustrated). The cooling fan 500 generates an air flow toward the openings Z formed in the photosensitive drum 121. A communicating air path 210R is formed between the cooling fan 500 and the duct part 210T. The air flow generated by the cooling fan 500 passes through the communicating air path 210R and enters the interior of the duct part 210T. In other words, the inlet opening 211 and cooling fan 500 mutually communicate through the communicating air path 210R and duct part 210T.

After having passed through the communicating air path 210R and duct part 210T, the air flow generated by the cooling fan 500 passes through the inlet opening 211, internal space 210S, and drum insertion part 21H and is led to the drum flange 121C of the photosensitive drum 121. The air flow then passes through the openings Z formed in the drum flange 121C and enters the cylindrical interior of the drum sleeve 121A (see the arrows D41, D42, and D43 in FIG. 4 and the arrow D9 in FIG. 9). In this embodiment, the bearing 121C2 of the photosensitive drum 121 is located inward of the flange part 121C1 in the axial direction. The openings Z are formed so as to extend in the axial direction by using the clearance between the flange part 121C1 and the bearing 121C2 in the axial direction. Thus, the amount of air passing through the openings Z can be increased. As a result, an air flow having a large amount of air is led to the cylindrical interior of the photosensitive drum 121, and therefore the photosensitive drum 121 is efficiently cooled. This suppresses the increase in temperature of the photosensitive drum 121 and thereby suppresses toner and an additive of the toner from adhering to the surface of the drum sleeve 121A. Since suppression of a temperature rise of the photosensitive drum 121 also suppresses the toner from becoming viscous, suppressing a toner transfer process at the transfer position TP from being impeded.

Since the duct part 210T is curved and erected as described above, when the air flow enters the internal space 210S from the duct part 210T through the inlet opening 211, the air flow forms a swirl flow in the internal space 210S. Accordingly, the air flow can easily enter the cylindrical interior of the drum sleeve 121A from the openings Z of the drum flange 121C, which is rotationally driven.

In the above embodiment, as described above, the bearing 121C2 of the drum flange 121C is located inward of the flange part 121C1 in the axial direction. In the drum flange 121C, the openings Z, which communicate with the cylindrical interior of the drum sleeve 121A, are formed between the flange part 121C1 and the bearing 121C2 in a plane intersecting the axial direction. Accordingly, the openings Z extending in the axial direction are formed unlike the situation in which the bearing 121C2 is located inward of the flange part 121C1 in a radial direction. As a result, air easily flows into the cylindrical interior of the drum sleeve 121A. Therefore, the interior of the photosensitive drum 121 is efficiently cooled.

In the above embodiment, the drum flange 121C is stably supported by a plurality of linking ribs 122. As a result, the rotation of the photosensitive drum 121 is stably maintained. In spite of the flange part 121C1 and bearing 121C2 being located at different positions in the axial direction as described above, one opening Z can be formed between each two of the plurality of linking ribs 122 can be formed.

So far, the photosensitive drum 121 and image forming apparatus 1 in an embodiment of the present invention have been described. However, the present invention is not limited to this embodiment. For example, a variation as described below can be used.

Figure 10A:
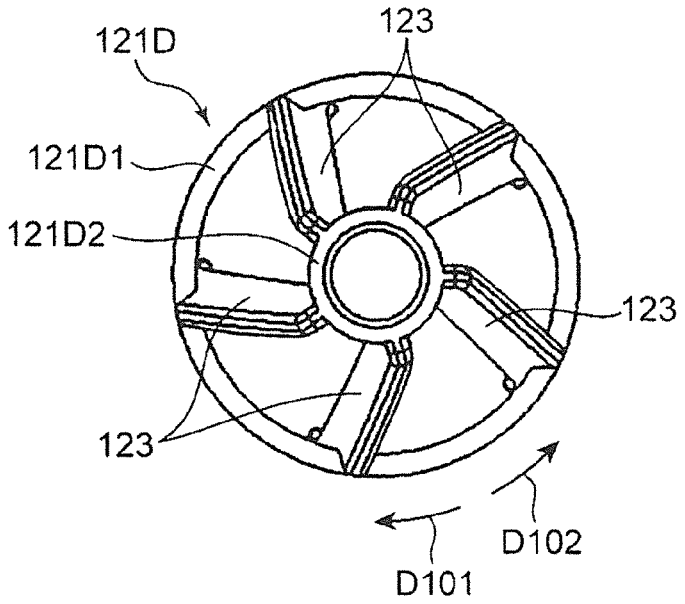
FIG. 10A is a front view illustrating a drum flange in another embodiment of the present disclosure.
Figure 10B:
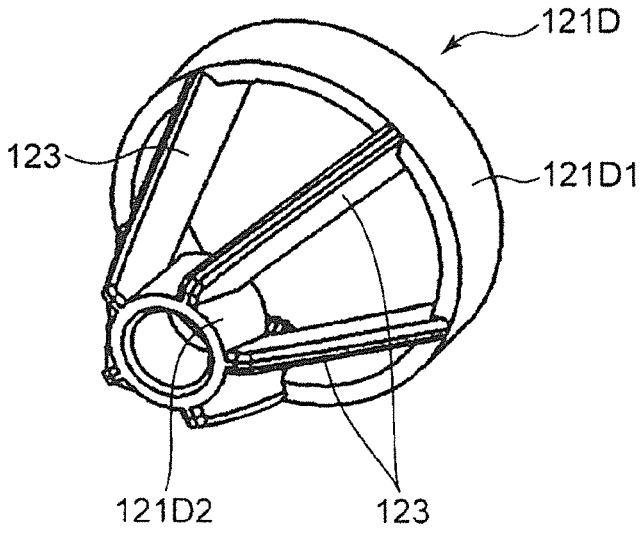
FIG. 10B is a perspective view illustrating the drum flange in another embodiment of the present disclosure.

(1) Although in the above embodiment the linking rib 122 is a plate-like member that has a slight thickness in the rotational direction of the photosensitive drum 121 and also has a defined width in the axial direction of the photosensitive drum 121, the present invention is not limited to this. FIG. 10A is a front view illustrating a drum flange 121D in a variation of the drum flange 121C, and FIG. 10B is a perspective view illustrating the drum flange 121D in the variation of the drum flange 121C. The variation is characterized in that slanted ribs 123 are used instead of the linking ribs 122 in the above embodiment. The slanted rib 123 has a slanted surface that is slanted along the rotational direction of the drum sleeve 121A. In other words, unlike the linking rib 122 described above, the inner edge of the slanted rib 123 in the axial direction (edge in front on the drawing sheet of FIG. 10A) is shifted in the direction indicated by the arrow D102, with respect to the outer edge in the axial direction (edge in back on the drawing sheet of FIG. 10A). As a result, the side surface of the slanted rib 123 is slanted in the rotational direction. In other words, the slanted rib 123 has a slanted surface that is slanted from the inner side in the axial direction toward the outer side in the axial direction along the rotational direction of the photosensitive drum 121. With this type of drum flange 121D, when the photosensitive drum 121 having the drum flange 121D is rotationally driven in the direction indicated by arrow D101 in FIG. 10A, air flow actively flows toward the cylindrical interior of the photosensitive drum 121 (toward the front on the drawing sheet of FIG. 10A). That is, the linking rib 122 doubles as a rotational fan that generates an air flow directed to the interior of the photosensitive drum 121.

(2) Although, in the above embodiment, the openings Z formed in the drum flange 121C have been described as being located at an end in the axial direction of the photosensitive drum 121, the present invention is not limited to this. Openings Z may also be formed in the drum flange 121C at the other end of the photosensitive drum 121. That is, a pair of drum flanges 121C, each of which has openings Z, is placed at both ends of the drum sleeve 121A. In this structure, a stable air flow is formed in the cylindrical interior of the photosensitive drum 121 in the axial direction. Therefore, the cooling of the photosensitive drum 121 is further enhanced.

In the variation in which the slanted rib 123 is used, at least one of a pair of drum flanges having slanted ribs slanted in a direction, with respect to the rotational direction of the photosensitive drum 121, opposite to the direction in which the slanted rib 123 is slanted may be located at a side end of the photosensitive drum 121, the side end being opposite to the drum flange 121D. This type of slanted rib has a slanted surface slanted from the outer side in the axial direction toward the inner side in the axial direction along the rotational direction of the photosensitive drum 121. In this structure, these slanted ribs generate an air flow directed toward the outer side of the photosensitive drum 121. Therefore, the air that has flowed into the cylindrical interior of the photosensitive drum 121 due to the slanted ribs 123 is exhausted to the outside of the photosensitive drum 121.

(3) Although the above embodiment has been described where the drum shaft 121B functions as a fixed axis, the present invention is not limited to this. The drum shaft 121B may be an axial part that is secured to the photosensitive drum 121 in an integrated manner and rotates together with the photosensitive drum 121. In this structure, the drum shaft 121B is secured to the bearing 121C2 of the photosensitive drum 121 in an integrated manner. When the photosensitive drum 121 is attached to the lower body 21, the top of the drum shaft 121B is inserted into the through-hole 21R1 formed in the back wall 21R, after which the drum shaft 121B is pivotably supported by the main body bearing 21J. When a driving unit (not illustrated) and the top of the drum shaft 121B are mutually linked, a rotational driving force is transmitted to the photosensitive drum 121. As a result, the photosensitive drum 121 becomes rotatable. In this variation, the drum shaft 121B functions as a rotational axis that is rotated together with the photosensitive drum 121.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A photosensitive drum comprising:

a drum sleeve, on a surface of which a latent image is formed, the drum sleeve supporting a toner image formed based the latent image;

a pair of drum flanges fitted to both ends of the drum sleeve, at least one of the drum flanges including a flange part that rotatably supports the drum sleeve in an integrated manner, a retaining part that retains a drum shaft and acts as a rotational axis when the drum sleeve rotates, an outside surface of the retaining part in an axial direction of the drum sleeve being located inward of the flange part in the axial direction of the drum sleeve, and a linking part that links the flange part and the retaining part together; and an opening is formed between the retaining part and the flange part of the pair of drum flanges each in a plane intersecting the axial direction, the opening communicating with a cylindrical interior of the drum sleeve.

2. The photosensitive drum according to claim 1, wherein:

the linking part extends toward a radial direction in the rotation of the drum sleeve and the axial direction, the linking part including a plurality of rib members that link the flange part and a bearing together; and the opening is formed between the plurality rib members.

3. The photosensitive drum according to claim 2, wherein each of the plurality of rib members has a slanted surface that is slanted along a rotational direction of the drum sleeve.

4. The photosensitive drum according to claim 1, wherein both of the pair of drum flanges are the same.

5. An image forming apparatus comprising:

a photosensitive drum that includes a drum sleeve, on a surface of which a latent image is formed, the drum sleeve supporting a toner image formed based on the latent image, and a pair of drum flanges each fitted to both ends of the drum sleeve, at least one of the drum flanges including a flange part that rotatably supports the drum sleeve in an integrated manner, a retaining part that retains a drum shaft and acts as a rotational axis when the drum sleeve rotates, an outside surface of the retaining part in an axial direction of the drum sleeve being located inward of the flange part in the axial direction of the drum sleeve, and a linking part that links the flange part and the retaining part together;

the drum shaft retained by the retaining part, the drum shaft acting as the rotational axis when the drum sleeve rotates;

a charger that substantially uniformly charges a circumferential surface of the photosensitive drum;

an exposing device that emits light to the circumferential surface, which has been charged by the charger, of the photosensitive drum;

a developing device that forms a toner image on the drum sleeve, on which the latent has been formed; and an opening is formed between the retaining part and the flange part of the pair of drum flanges each in a plane intersecting the axial direction, the opening communicating with a cylindrical interior of the drum sleeve.

6. The image forming apparatus according to claim 5, wherein:

the linking part extends toward a radial direction in the rotation of the drum sleeve and the axial direction, the linking part including a plurality of rib members that link the flange part and a bearing together; and the opening is formed between the plurality rib members.

7. The image forming apparatus according to claim 6, wherein each of the plurality of rib members has a slanted surface that is slanted along a rotational direction of the drum sleeve.

8. The image forming apparatus according to claim 5, wherein both of the pair of drum flanges are the same.

9. The image forming apparatus according to claim 5, comprising an air flow generating source that generates an air flow that enters the opening in the photosensitive drum.

10. The image forming apparatus according to claim 9, comprising:

a cylindrical part that has an internal space facing the drum flange in the axial direction;

an inlet opening formed in a wall of the cylindrical part; and a duct through which the inlet opening and the air flow generating source mutually communicate.

* * * * *